US005651245A

United States Patent [19]

Damien

[11] Patent Number: 5,651,245

[45] Date of Patent: Jul. 29, 1997

[54] LIFTING CABLE HAVING METALLIC CENTRAL CORE AND HYBRID OUTER STRANDS

[75] Inventor: Jean-Pierre Damien, Saint Denis les Bourg, France

[73] Assignee: Trefileurope France, Bourg en Bresse, France

[21] Appl. No.: 578,053

[22] Filed: Dec. 22, 1995

Related U.S. Application Data

[63] Continuation of Ser. No. 265,807, Jun. 27, 1994, abandoned.

[30] Foreign Application Priority Data

Jun. 27, 1994 [FR] France ..... 93 08648

[51] Int. Cl.[6] ..... D02G 3/36; D07B 1/06

[52] U.S. Cl. ..... 57/220; 57/214; 57/216; 57/218; 57/222

[58] Field of Search ..... 57/214, 215, 216, 57/218, 219, 220, 221, 222

[56] References Cited

U.S. PATENT DOCUMENTS

| | | | |
|---|---|---|---|
| 2,348,234 | 5/1944 | Warren | 57/220 |
| 3,075,344 | 1/1963 | Fenner | 57/216 |
| 3,729,921 | 5/1973 | Stroh | 57/214 |
| 4,034,547 | 7/1977 | Loos | 57/211 |

FOREIGN PATENT DOCUMENTS

| | | | |
|---|---|---|---|
| 3934270 | 4/1991 | Germany . | |
| 53-122842 | 10/1978 | Japan | 57/220 |
| 2219014 | 11/1989 | United Kingdom | 57/220 |

*Primary Examiner*—William Stryjewski

*Attorney, Agent, or Firm*—Sixbey Friedman Leedom & Ferguson; Thomas W. Cole

[57] ABSTRACT

The cable includes a substantially metallic central core (3) and outer strands (2) formed from at least one layer of metal wires (21), particularly steel wires, which are stranded over a core element (22) made from synthetic material, preferably a thermoplastic material, this being with a pitch similar to that of the strands (5,6) with which the core (3) is formed, it being possible for the latter to be entirely metallic or hybrid. These cables are intended particularly for use as a lifting cable, particularly elevator cables, or other multicable installations with transmission by means of adherence.

8 Claims, 1 Drawing Sheet

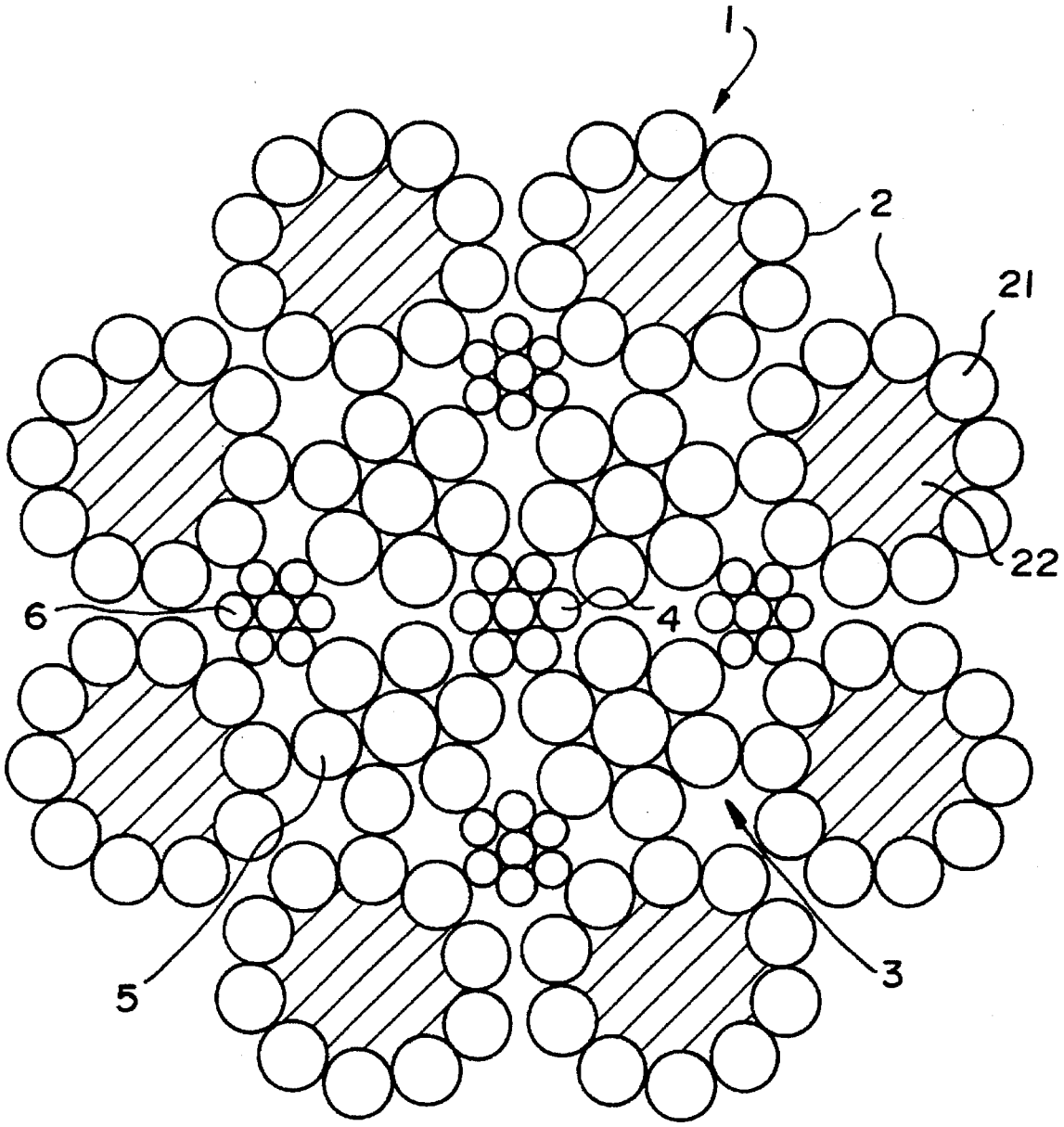
1
2
21
22
6
4
5
3

LIFTING CABLE HAVING METALLIC CENTRAL CORE AND HYBRID OUTER STRANDS

This application is a Continuation Continuation-in-Part of Ser. No. 08/265,807, filed Jun. 27, 1994, now abandoned.

FIELD OF THE INVENTION

The present invention relates to multistrand lifting cables which are intended particularly for working in transmission by means of adherence, such as cables for elevators.

PRIOR ART

These cables are currently formed either entirely with outer strands and a core made from steel, or with metal outer strands and a central core which is non-metallic or partially metallic.

The core must ensure a correct geometry for the architecture of the outer strands which it supports and, in particular, ensure sufficient functional clearance between these strands to prevent them coming into intimate mutual contact, which would give rise to friction and to wear of the wires in contact, with risks of seizure, indentation, contact corrosion and rupture.

In the case of entirely metallic cables, the steel core makes it possible to ensure this correct geometry owing to the fact that the core is barely deformable radially. However, the mass per unit length of these all-steel cables is considerable. Moreover, as the outer strands are also made from steel (thus, likewise, barely deformable radially), the contact pressures exerted by these outer strands on the core are very great, particularly when winding over pulleys or onto drums. This results in risks of wear and indentation between the outer strands and the core. Similarly, the high contact pressure of the outer strands on the pulleys or drums may give rise to damage to the latter.

It is for this reason that use is currently made in applications of this type, particularly as elevator cable, of cables with outer strands made from steel and a core made from a natural textile with hard fibers, such as sisal.

These cables have amass per unit length which is lower than all-steel cables and combine various advantages:

- the core made from natural fibers forms a reservoir for the lubricant with which it is impregnated and which is extruded during compression of the core by the outer strands;
- the friction of the outer strands on the core is low, which gives this type of cable great flexibility.

In elevator installations, the cables are generally mounted on one and the same drive pulley as a layer of several parallel cables or "cords". So that the total load is durably distributed over all these cords, it is necessary for the set of cords to behave homogeneously when in service, particularly as regards their diameter and, correlatively, their permanent elongation. In fact, so that the tensions in each of the cords are equivalent, it is essential for the diameters to be equal and constant. If this is not so, certain cords will be under tension and others will be slack, which gives rise to vibrations and differential snaking (localized takeup of the displacement of one cord with respect to the other) which causes wear of the cables and of the grooves of the drive pulley.

From this standpoint, cables with a core made from sisal have the drawback of their irregular diameters and their susceptibility to compression under tension and under associated alternate flexing/tensioning operating cycles, which give rise to variations in elongation and the consequences thereof indicated above.

In addition, there are, currently, increasing difficulties in supplying sisal fibers which originate from a plant whose cultivation is disappearing.

Attempts have been made to replace sisal with synthetic fibers but, on the one hand, these fibers are less effective than sisal in terms of their function as a lubricant reservoir and, on the other hand, the characteristics of friction of the core on the outer strands are markedly less. The result of this is that the cables are less fatigue-resistant owing to the in-service abrasion of the core by the strands which, moreover, causes wear of the core, reduction in the diameter of the cable and resulting permanent elongation.

SUMMARY OF THE INVENTION

The object of the invention is to propose a novel lifting cable, particularly suited for elevators or similar lifting gear which makes it possible to solve the various problems indicated above, has very good uniformity of diameter, reduced permanent elongation and does not give rise to damage of the members for winding this cable.

With these objectives in view, the subject of the present invention is a cable including a plurality of outer strands formed with metal wires, these strands being cabled over a central core. According to the invention, this cable is defined in that the outer strands are formed from at least one layer of metal wires stranded over a core element made from synthetic material and at a pitch similar to that of the strands from which the core itself is formed.

The core of the cable is preferably entirely metallic, or hybrid, that is to say composed both of metal strands and elements made from plastic material.

The cable according to the invention thus has great geometrical stability by virtue of the metal core which is barely compressible, and thus has notably reduced in-service permanent elongation. Its mass per unit length is equal or at least very close to that of an equivalent cable with metal outer strands over a core made from natural textile fibers, and thus less than that of an entirely metallic cable of identical diameter.

In addition, the synthetic plastic material of the core element of the outer strands enables the latter to deform during winding over pulleys or onto drums, matching the shape of the groove in which the cable rests. This ensures virtually ideal distribution of the contact pressures and thus a sharp reduction in these pressures between the outer strands and the core, which reduces the risks of indentation since the strands of the core and these outer strands are wound up with a similar pitch. A sharp reduction in pressure thus also takes place between the outer strands and the winding members, which reduces the risks of damage to these members. This results in a fatigue strength of the cable according to the invention which is very markedly improved in comparison to that of a cable over a textile core.

Moreover, owing to production over a dimensionally stable metallic core and to the layer or layers of metal wires of the outer strands, the manufacturing tolerance on the cable diameter can be markedly reduced, passing to −0, +3 % of the nominal diameter, as against −0, +5 or 6% for a cable with a textile core.

BRIEF DESCRIPTION OF THE DRAWING

Other characteristics and advantages will become apparent in the following description which is made by way of example of a lifting cable in accordance with the invention, intended particularly for use as elevator cable or for multi-cable installations with transmission by means of adherence.

Reference will be made to the appended drawing which represents the cross section of this cable.

DESCRIPTION OF THE PREFERRED EMBODIMENT

The cable 1 includes several outer strands 2, eight in the example shown, surrounding a core 3. The core 3 itself includes a central core member 4 (advantageously formed from a strand itself); four main strands 5 and four secondary strands 6. All the strands of the core are made from steel and assembled as a Lang's lay.

The outer strands 2 are assembled as an ordinary lay, parallel to and at the same pitch as the strands of the core which are themselves assembled so that all the inter-layer contacts and contacts between the various adjacent strands are linear, which makes it possible to reduce the contact pressures and thus the risks of indentation.

The outer strands 2 are formed from an external layer of steel wires 21 stranded over a central support 22 made from synthetic material having good mechanical qualities, for example from polyethylene, polypropylene, polyamide or other similar substances, preferably of a thermoplastic type.

The central support may also include aromatic fibers, carbon fibers or glass fibers or other fibers with high mechanical strength, covered with a polyethylene, polypropylene, polyamide sheath or a sheath made from other similar substances.

The outer strands 2 are preferably made by positioning the wires 21 of the external layer over a bead of said synthetic material which is softened by heating so that the wires 21 are embedded in the synthetic material and so that the latter flows between the wires, filling in all the gaps between the latter.

Although, in the example shown if the figure, there is only one layer of wires 21, it is also possible to form the outer strands 2 with several layers of these wires, for example two, assembled as indicated above so that the synthetic material fills in the spaces between the wires in contact with it.

The outer strands may, in particular, be manufactured in a manner similar to the method described for producing cables with a non-metallic core in the document FR-A-1, 601,293, to which reference may be made for further information.

However, it is recalled that, in accordance with this method, the bead of synthetic material intended to constitute the central support 22 is, prior to the positioning of the outer wires, at least partially shaped to the inner profile of the layer of wires which it will support after twisting, which makes it possible to control the geometry of the strand, via the automatic prepositioning of the wires on said bead.

As already indicated above, the outer strands 2 are cabled at the same pitch as the strands 5, 6 of the core and parallel to the latter. This preferred arrangement also has the advantage of permitting manufacture of the cable in a single cabling operation, during which all the strands, core strands and outer strands, are assembled simultaneously in the same cabling phase.

The synthetic material of the central support 22 of the outer strands 2 permits very good distribution of the contact pressures of these strands on the winding members such as pulleys or drum, owing to the fact that said material enables the outer strands to deform elastically in their cross section and thus better match the profile of the grooves or bearing surfaces of the winding members.

For the same reasons, the distribution of the contact pressures of the outer strands on the strands of the core is considerably improved in comparison to cables with all-metal outer strands over a core which is also metallic or hybrid. This results in very low wear of the metal core.

In addition to the advantages indicated above, relating to the conditions of use of the cable, the invention also makes it possible, by virtue of the use of a metal core, to reduce the tolerance on the nominal diameter which may be halved in comparison to equivalent cables with a textile core for the intended application.

Moreover, the structure of the cable according to the invention, by limiting its in-service diametrical compaction, makes it possible to considerably reduce the in-service permanent elongation. Tests carried out have made it possible to observe a permanent elongation which is three to six times less than that of the cables of the prior art with a textile core made from sisal.

By way of example, a table is given below which compares the results of tests performed on a cable with a textile core according to the prior art and on a cable according to the invention.

These data are measured before, then during and after a conventional fatigue test over a pulley of 300 mm diameter and relate to cables having a nominal diameter of 13 mm:

| | Textile core | Cable according to the invention |
|---|---|---|
| Diameter without tension before the test | 13.30 mm | 13.15 mm |
| Diameter without tension after 200,000 alternating movements over a pulley | 12.75 mm | 12.95 mm |
| Permanent elongation after 200,000 alternating movements over a pulley | 0.35% | 0.06% |
| Outer wires broken after 200,000 alternating movements over a pulley | 20 | 0 |
| Examination of the core after 600,000 alternating movements | / | no broken wires |

However, the invention is not limited to the embodiment of the cable described above by way of example. In particular, the composition of the core may be other than that indicated above, the number, the constitution and the relative position of the strands of the metal core may be modified without adversely affecting the specific advantages resulting from the use of the outer strands in accordance with the invention.

The number of these outer strands may also be modified.

Finally, the core of the cable may also be of the hybrid-core type, that is to say including metal strands and beads made from synthetic materials placed between these strands. For example, the central core member 4 and/or the secondary strands 6 may be replaced by thermoplastic beads which may fill in, at least partially, the spaces between the core strands or between the core strands and the outer strands.

I claim:

1. A cable composed of a central core and a plurality of outer strands including metal wires, said outer strands being laid over the central core, wherein the outer strands are formed from at least one layer of metal wires stranded over a core element made from synthetic material;

the central core itself is substantially metallic with respect to a cross-sectional area of said central core, and includes strands cabled over a central core member, the diameter of said central core being substantially larger than the diameter of any of the outer strands, and the outer strands are cabled at the same pitch as the strands of the central core and are parallel to the latter.

2. The cable as claimed in claim 1, wherein the central core is entirely metallic.

3. The cable as claimed in claim 2, wherein the central core member is itself made up of a core strand.

4. The cable as claimed in claim 1, wherein the synthetic material making up the core element of the outer strands is thermoplastic.

5. The cable as claimed in claim 1, wherein the core element of the outer strands includes fibers selected from the group consisting of aromatic fibers, carbon fibers and glass fibers.

6. The cable as claimed in claim 1, wherein the core element of the outer strands includes synthetic fibers with high mechanical strength which are coated with a sheath of thermoplastic material.

7. The cable as claimed in claim 1, wherein the synthetic material making up the core element of the outer strands is a material selected from the group consisting of polyethylene, polypropylene and polyamide.

8. The cable as claimed in claim 1 wherein the central core itself is entirely metallic.

* * * * *